US006505801B2

(12) United States Patent
Zerres

(10) Patent No.: US 6,505,801 B2
(45) Date of Patent: Jan. 14, 2003

(54) STRUCTURAL COMPONENT FOR SECURING TILES ONTO A READY-MADE CHIMNEY

(75) Inventor: Manfred Zerres, Woldert (DE)

(73) Assignee: MEZ Keramik GmbH, Dernbach (DE)

( * ) Notice: Subject to any disclaimer, the term of this patent is extended or adjusted under 35 U.S.C. 154(b) by 0 days.

(21) Appl. No.: 09/815,290

(22) Filed: Mar. 22, 2001

(65) Prior Publication Data

US 2002/0008182 A1 Jan. 24, 2002

(30) Foreign Application Priority Data

Mar. 23, 2000 (DE) ..... 200 05 465 U

(51) Int. Cl.[7] ..... A47F 5/00

(52) U.S. Cl. ..... 248/300; 248/229.16; 248/316.7

(58) Field of Search ..... 248/300, 301, 248/316.7, 229.16, 229.26, 228.7, 230.7, 305, 309.1, 475.1; 211/208, 187

(56) References Cited

U.S. PATENT DOCUMENTS 3,631,821 A * 1/1972 Zachariou ..... 248/243
4,711,183 A * 12/1987 Handler et al. ..... 248/243

* cited by examiner

*Primary Examiner*—Ramon O. Ramirez
(74) *Attorney, Agent, or Firm*—Friedrich Kueffner

(57) ABSTRACT

A structural component for securing tiles onto a metallic housing of a ready-made chimney, wherein the tiles have side surfaces and wherein the side surfaces have grooves and tongues complementing one another, has hoops to be fastened on the metallic housing at a given distance from one another which distance matches the size of the tiles. Brackets are provided that are insertable into the hoops. The brackets are snapped into place between two adjacent tiles.

4 Claims, 1 Drawing Sheet

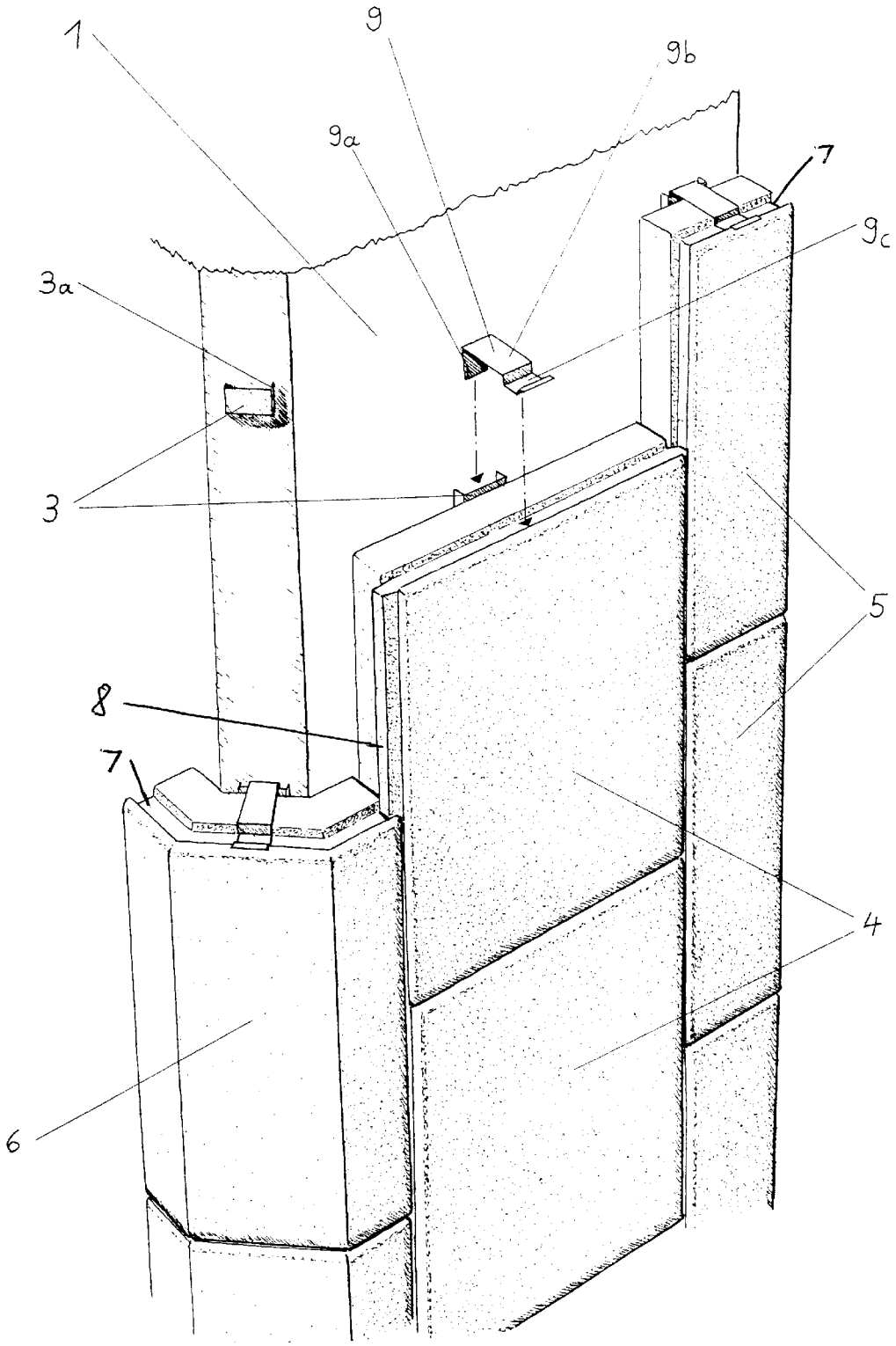
1
9
9b
9a
7
9c
3a
3
5
8
7
4
6

STRUCTURAL COMPONENT FOR SECURING TILES ONTO A READY-MADE CHIMNEY

BACKGROUND OF THE INVENTION

1. Field of the Invention

The invention relates to a structural component for securing tiles onto a metallic housing of a ready-made chimney, wherein the tiles at their side surfaces are mutually provided with grooves and tongues complementing one another.

2. Description of the Related Art

So-called ready-made chimneys are known, which are comprised of a metallic housing, i.e., a chimney stove, in which the proper fireplace is located and to which a flue or an outlet chimney is connected. This metallic housing is then clad for heat accumulation with tiles, which at their side surfaces are mutually provided with grooves and tongues complementing one another. With this configuration, it is possible to brick tile on tile or tile next to tile, respectively, with a heat-resistant mortar. This not only requires a special skill but is also time-consuming. Such a tile stove is relatively expensive. There are also known ready-made chimneys which are offered as do-it-yourself kits and for which horizontal and/or vertical rails are provided, which, on the one hand, support the installation of the tiles and therefore facilitate same, and, on the other hand, provide the tiles with the required rigidity and strength. In connection with the use of these rails, it is unfavorable that at least their edges are visible, which unfavorably impairs the visual appearance of such a ready-made chimney.

SUMMARY OF THE INVENTION

It is an object of the present invention to provide a structural component for securing tiles onto the metallic housing of a ready-made chimney, with which the installation of the tiles around the housing, the so-called ready-made chimney, is considerably simplified and which moreover assures that the ready-made chimney or tile stove has a pleasing appearance that is not impaired by metallic parts and looks like a tile stove that has been built by a skilled person.

In accordance with the present invention, this is achieved in that a structural component is proposed, comprising hoops, which at a given distance from one another, corresponding to the size of the tiles, are fastenable on the metallic housing, and further comprising brackets which are insertable into the hoops and snap into place between two adjacent tiles.

By means of such a structural component where the hoops are already connected to the metallic housing, for example, by welding, any horizontal position of the tiles is secured at the metallic housing such that, on the one hand, the brackets are inserted into the hoops and, on the other hand, they are locked into place into an upright tile, in which they are secured by a further tile placed on the upright tile. By doing so, a safe connection between the tiles and the metallic housing is achieved, and the ready-made chimney or pre-assembled tile stove has the desired appearance. The assembly may be carried out in a relatively short time and requires no special skills.

BRIEF DESCRIPTION OF THE DRAWING

In the drawing the only FIGURE shows a perspective detail of a metal housing with hoops and brackets for securing the tiles thereon.

DESCRIPTION OF THE PREFERRED EMBODIMENTS

In the only FIGURE a detail of a metallic housing 1, for example, made of steel, is shown constituting the so-called fireplace of a chimney stove or tile stove, not shown. The housing 1 is connected via a flue, not shown, to an exhaust chimney, also not shown. Furthermore, the housing 1 is provided with a closable opening for the fireplace, not shown in the drawing. A plurality of hoops 3 is provided at the metallic housing 1, the hoops 3 consisting of metal and connected by welding or riveting to the metallic housing 1. These hoops 3, in the shown embodiment, have a U-shaped form, wherein the free ends of the legs 3*a* of the hoops 3 are welded or riveted to the metallic housing 1. If needed, special fastening projections, not shown, may adjoin the free ends of the legs and extend parallel to the stay connecting the legs. The fastening projections are provided for connecting the hoops 3 by welding or riveting to the metallic housing 1.

For assembling the tile stove, the metallic housing 1 is then clad with tiles 4, 5, 6, which are differently embodied or shaped. In addition to regular tiles 4 there are half tiles 5, which either have, as shown, the length and half the width of tile 4, or have the width of a regular tile 4 but only half its length. In addition to these half tiles 5, there are quoin tiles 6 as well as molding tiles, not shown. The tiles 4, 5, 6 in the shown embodiment have a given distance to the metallic housing 1 and are mutually provided at the side surfaces with grooves 7 and tongues 8, which have in the shown embodiment an almost identical, trapezoidal cross section. The tongues 8 and the grooves 7 make it possible that the tiles 4, 5, 6—with their visible surface facing to the outside—are positionable around the metallic housing 1. For mounting the lowermost tiles 4, 5, 6, it is possible to use a prefabricated frame.

In order to provide the tiles 4, 5, 6 with the necessary support, metallic brackets 9 are used. These brackets 9 have an L-shaped form and comprise two legs 9*a*, 9*b*, which run perpendicularly to each other. The shorter leg 9*a* is inserted from above into a hoop 3, which is positioned on the metallic housing 1. The other, longer legs 9*b* of the brackets 9 are shaped such that they may snap into a gap between two stacked tiles 4, 5, 6. For this purpose, the leg 9*b* has a crimp 9*c* having a U-shaped form matched to the cross-section of the grooves 7 and tongues 8. Other shapes of the crimp 9*c* are also possible. Decisive for the chosen shape of the crimp 9*c* is that the upper parts of the tiles 4, 5, 6 are secured against movement due to this shape of the crimp 9*c*.

When fixing or mounting the tiles 4, 5, 6, first the lowermost line of the tiles 4, 5, 6 is placed. After this, the brackets 9 are suspended from the hoops 3 by means of their legs 9*a*. Thereby the crimps 9*c* engage the grooves 7 of the tiles 4, 5, 6. Thereafter, a further line of tiles is placed, and, after that, the already described suspending of the brackets 9 is repeated. It is practical, but not absolutely compulsory, that the grooves 7 are located topside when placing of the tiles 4, 5, 6. The described placing of the tiles 4, 5, 6 requires that the hoops 3 are located in the exactly given positions at the metallic housing 1, wherein the distance between two stacked lines of hoops 3 corresponds to the height of the tiles 4, 5, 6.

In modifying the illustrated embodiment, it is possible to provide brackets 9 at the vertical side surfaces of the tiles 4, 5, 6 and to suspend them from hoops 3 which are located at the metallic housing 1. However, this is not compulsory or compulsory only in special cases. Moreover, the hoops 3 and the brackets 9 may be formed or shaped differently.

While specific embodiments of the invention have been shown and described in detail to illustrate the inventive principles, it will be understood that the invention may be embodied otherwise without departing from such principles.

What is claimed is:

1. A structural component for securing tiles onto a metallic housing of a ready-made chimney, wherein the tiles have side surfaces and wherein the side surfaces have grooves and tongues complementing one another, the structural component comprising:

hoops configured to be fastened on the metallic housing at a given distance, matching the size of the tiles, from one another;

brackets configured to be inserted into the hoops, wherein the brackets are configured to be snapped into place between two adjacent tiles, wherein the hoops have a U-shaped cross section having legs with free ends and a stay connecting the legs, wherein the hoops have fastening projections adjoining the free ends of the legs and extending parallel to the stay.

2. A structural component for securing tiles onto a metallic housing of a ready-made chimney, wherein the tiles have side surface and wherein the side surfaces have grooves and tongues complementing one another, the structural component comprising:

hoops configured to be fastened on the metallic housing at a given distance, matching the size of the tiles, from one another;

brackets configured to be inserted into the hoops, wherein the brackets are configured to be snapped into place between two adjacent tiles, wherein the bracket is L-shaped and has a first leg insertable into the hoop and a second leg configured to snap into place between two adjacent tiles.

3. The structural component according to claim 2, wherein the second leg of the bracket projecting between two tiles has a free end and is provided with a crimp in the vicinity of the free end.

4. The structural component according to claim 3, wherein the crimp is U-shaped and matches a cross section defined between the groove and the tongue of two adjacent tiles.

* * * * *